US012091969B2

(12) United States Patent
Alissa et al.

(10) Patent No.: US 12,091,969 B2
(45) Date of Patent: Sep. 17, 2024

(54) SUBSURFACE SAMPLING TOOL

(71) Applicant: SAUDI ARABIAN OIL COMPANY, Dhahran (SA)

(72) Inventors: Faisal Alissa, Dammam (SA); Khalid Alamari, Riyadh (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 73 days.

(21) Appl. No.: 18/061,002

(22) Filed: Dec. 2, 2022

(65) Prior Publication Data

US 2024/0183271 A1 Jun. 6, 2024

(51) Int. Cl.
*E21B 49/08* (2006.01)

(52) U.S. Cl.
CPC ..... *E21B 49/0813* (2020.05); *E21B 49/082* (2013.01)

(58) Field of Classification Search
CPC ..... E21B 27/00; E21B 27/005; E21B 49/081; E21B 49/0813; E21B 49/0815; E21B 49/082; E21B 49/083; G01N 1/12
See application file for complete search history.

(56) References Cited

U.S. PATENT DOCUMENTS 1,787,001 A * 12/1930 Hunt ..... E21B 11/04 175/203
2,176,240 A * 10/1939 Bandy ..... E21B 49/083 175/314
2,623,594 A * 12/1952 Sewell ..... E21B 49/10 166/100
2,745,496 A * 5/1956 Blood ..... E21B 33/127 277/331
3,055,764 A * 9/1962 Pryor ..... E21B 49/081 166/69

(Continued)

FOREIGN PATENT DOCUMENTS

EP 0903464 A2 3/1999
GB 2215704 A * 9/1989 ..... E21B 49/082
WO 9612088 A1 4/1996

OTHER PUBLICATIONS

Written Opinion and International Search Report from corresponding PCT Application No. PCT/US2023/081679 mailed Mar. 19, 2024.

*Primary Examiner* — Jennifer H Gay
(74) *Attorney, Agent, or Firm* — Vorys, Sater, Seymour and Pease LLP

(57) ABSTRACT

A downhole sampling tool includes a tool body defining an opening therein for drawing a formation fluid into the downhole sampling tool. At least one sampling vessel is carried in the tool body and is operatively coupled to the opening to receive the formation fluid therein. A closure member is selectively engageable with the opening to prohibit flow of the formation fluid through the opening, and a biasing mechanism is operably coupled to the closure member. The biasing mechanism biases the closure member into engagement with the opening and is responsive to an increase in hydraulic pressure on the exterior of the sampling tool to a predetermined threshold pressure to permit movement of the closure member away from the opening and permit flow of the formation fluid through the opening and into the sampling vessel.

20 Claims, 4 Drawing Sheets

(56) References Cited

U.S. PATENT DOCUMENTS

| | | | | | |
|---|---|---|---|---|---|
| 3,441,095 | A * | 4/1969 | Youmans | E21B 49/083 175/4.52 |
| 5,228,345 | A * | 7/1993 | Vales | G01N 1/12 166/264 |
| 5,337,822 | A | 8/1994 | Massie et al. | |
| 5,377,755 | A | 1/1995 | Michaels et al. | |
| 5,404,949 | A * | 4/1995 | Voss | G01N 1/10 166/264 |
| 5,473,939 | A | 12/1995 | Leder et al. | |
| 5,609,205 | A | 3/1997 | Massie et al. | |
| 6,431,272 | B1 * | 8/2002 | Pratt | G01N 1/12 166/99 |
| 6,601,889 | B2 * | 8/2003 | Pratt | E21B 27/00 166/162 |
| 7,195,063 | B2 | 3/2007 | Nogueira et al. | |
| 7,469,746 | B2 | 12/2008 | Tarvin et al. | |
| 7,656,705 | B2 | 2/2010 | Hamilton et al. | |
| 8,245,781 | B2 | 8/2012 | Ciglenex et al. | |
| 9,328,580 | B2 * | 5/2016 | Tinnen | E21B 27/00 |
| 2002/0104648 | A1 * | 8/2002 | Pratt | E21B 49/082 166/168 |
| 2003/0075940 | A1 * | 4/2003 | Pratt | G01N 1/12 294/68.25 |
| 2012/0291566 | A1 * | 11/2012 | Zeller | E21B 49/082 73/864 |
| 2014/0262299 | A1 * | 9/2014 | Tinnen | E21B 27/00 166/107 |
| 2017/0275977 | A1 * | 9/2017 | Varela | E21B 33/068 |
| 2020/0378251 | A1 * | 12/2020 | McAdam | F16K 15/036 |

* cited by examiner

SUBSURFACE SAMPLING TOOL

FIELD OF THE DISCLOSURE

The present disclosure relates generally to subterranean tools and methods for accessing geologic formations through a wellbore and, more particularly, to retrieving samples of fluids present in the geologic formations by deploying a sampling tool into the wellbore.

BACKGROUND OF THE DISCLOSURE

Wellbores may be drilled to recover natural deposits of oil and gas, as well as other desirable materials that are trapped in subterranean geological formations. Samples of the fluids present in these formations are often collected for analysis at the surface. For example, fluid samples may be analyzed to determine various formation properties such as permeability, fluid type, fluid quality, formation temperature, formation pressure, bubblepoint and formation pressure gradient. This information may be relevant to assessing the existence, composition and producibility of subterranean hydrocarbon fluid reservoirs. Also, in producing wellbores, this information may facilitate the assessment of the potential for scale development on wellbore equipment.

For the analysis of formation fluids to be accurate, the samples collected must adequately represent the fluid contained in the formation. For example, the fluid samples should be substantially free of contamination from fluids originating in other locations in the wellbore. Also, the sample should be analyzed under the same conditions in which the sample was collected if possible to ensure the fluid sample does not undergo alterations that could impair the analysis. For example, if a fluid sample is analyzed at the surface where the fluid sample is exposed to much lower ambient pressures than in the wellbore, gasses may escape a liquid component of the fluid sample, which may alter the chemical composition, pH and other characteristics of the fluid sample. These alterations could lead to inaccuracies in the analysis and incorrect conclusions being drawn therefrom.

SUMMARY OF THE DISCLOSURE

Various details of the present disclosure are hereinafter summarized to provide a basic understanding. This summary is not an extensive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure, a downhole fluid sampling tool includes a tool body defining an opening therein for drawing a formation fluid into the downhole sampling tool, a sampling vessel carried in the tool body and operatively coupled to the opening to receive the formation fluid into an interior thereof, a closure member selectively engageable with the opening to prohibit flow of the formation fluid through the opening and a biasing mechanism operably coupled to the closure member. The biasing member is operable to bias the closure member into engagement with the opening and responsive to an increase in hydraulic pressure on the exterior of the sampling tool to a predetermined threshold pressure to permit movement of the closure member away from the opening and permit flow of the formation fluid through the opening and into the interior of the sampling vessel.

In another embodiment, a downhole fluid sampling system includes a conveyance deployable into a wellbore and a tool body coupled to an end of the conveyance. The tool body defines an opening therein. At least one sampling vessel is carried in the tool body, and the sampling vessel is operatively coupled to the opening to receive formation fluid into an interior of the sampling vessel. A closure member is selectively engageable with the opening to prohibit flow of the formation fluid through the opening. A biasing mechanism is operably coupled to the closure member to bias the closure member into engagement with the opening and is responsive to an increase in hydraulic pressure on the exterior of the too body to a predetermined threshold pressure to permit movement of the closure member away from the opening and permit flow of the formation fluid through the opening and into the interior of the sampling vessel.

In another embodiment, a method for collecting and analyzing a downhole fluid sample includes (a) lowering a sampling tool into a wellbore to a predetermined depth, (b) applying wellbore pressure at the predetermined depth to a closure member carried by the sampling tool to establish fluid communication between an exterior of the sampling tool and an interior of a sampling vessel carried by the sampling tool, (c) receiving a sample of wellbore fluid from the predetermined depth into the sampling vessel, (d) raising the sampling tool in the wellbore above the predetermined depth and (e) applying a biasing force to the closure member to obstruct fluid flow between the exterior of the sampling tool and the interior of the sampling vessel in response to raising the sampling tool.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1:
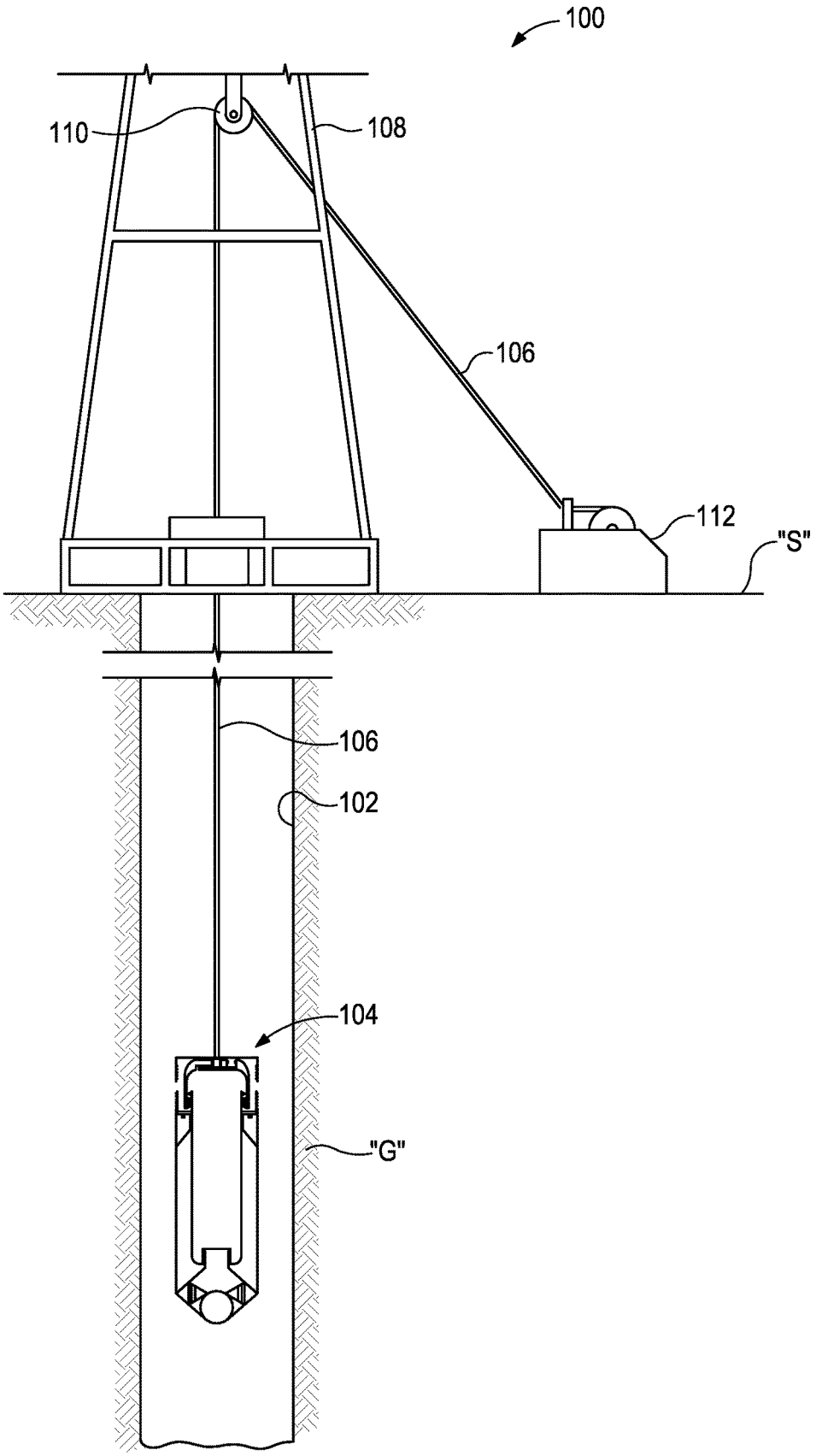
FIG. 1 is a schematic diagram of a well system including a subsurface fluid sampling tool deployed on a slickline in accordance with aspects of the present disclosure.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

Embodiments in accordance with the present disclosure generally relate to collecting fluid samples from subterranean formations and maintaining the fluid samples in conditions that facilitate an accurate analysis of the fluid sample. A sampling tool in accordance with the present disclosure includes a sealing mechanism that is responsive to changes in the ambient pressure surrounding the sampling tool to ensure uncontaminated fluid samples are collected. Because the sealing mechanism is responsive to changes in the ambient pressure, no electrical power, instructional data or activating fluid pressure is required to open and close the sampling tool downhole.

FIG. 1 is a schematic diagram of an example well system 100 that may employ one or more of the principles of the present disclosure, according to one or more embodiments. As depicted, the well system 100 includes a wellbore 102 that extends from a surface location "S" through a subterranean geologic formation "G." Wellbore 102 extends from a terrestrial surface location "S," but aspects of the present disclosure may be also practiced in offshore and subsea wellbores without departing from the scope of the disclosure. Similarly, although wellbore 102 extends along a generally vertical trajectory, aspects of the present disclosure may be also practiced in wellbores extending along deviated, horizontal or other trajectories. A sampling tool 104 is provided in the wellbore 102 for the collection and transport of fluid samples within the wellbore 102. The sampling tool 104 may be conveyed through the wellbore 102 on a slickline 106.

To support the slickline 106, well system 100 includes a derrick 108 supporting a pulley 110 over the wellbore 102. In some slickline operations, an arrangement of cables, cranes and other equipment (not shown) may substitute for the derrick 108. The pulley 110 guides the slickline 106 out of the wellbore 102 to a winch 112. The winch 102 may be operated to wind and unwind the slickline 106 to respectively raise (convey uphole) and lower (convey downhole) the sampling tool 104 in the wellbore 102. The slickline 106 may be constructed as thin nonelectric cable devoid of any power or fluid transmission conduits since sampling tool 104 is operable without power or fluids provided through the slickline 106. In other embodiments, other types of conveyance, such as wireline, coiled tubing, drill strings, etc. may be employed to raise and lower the sampling tool 104 without departing from the scope of the disclosure.

Figure 2A:
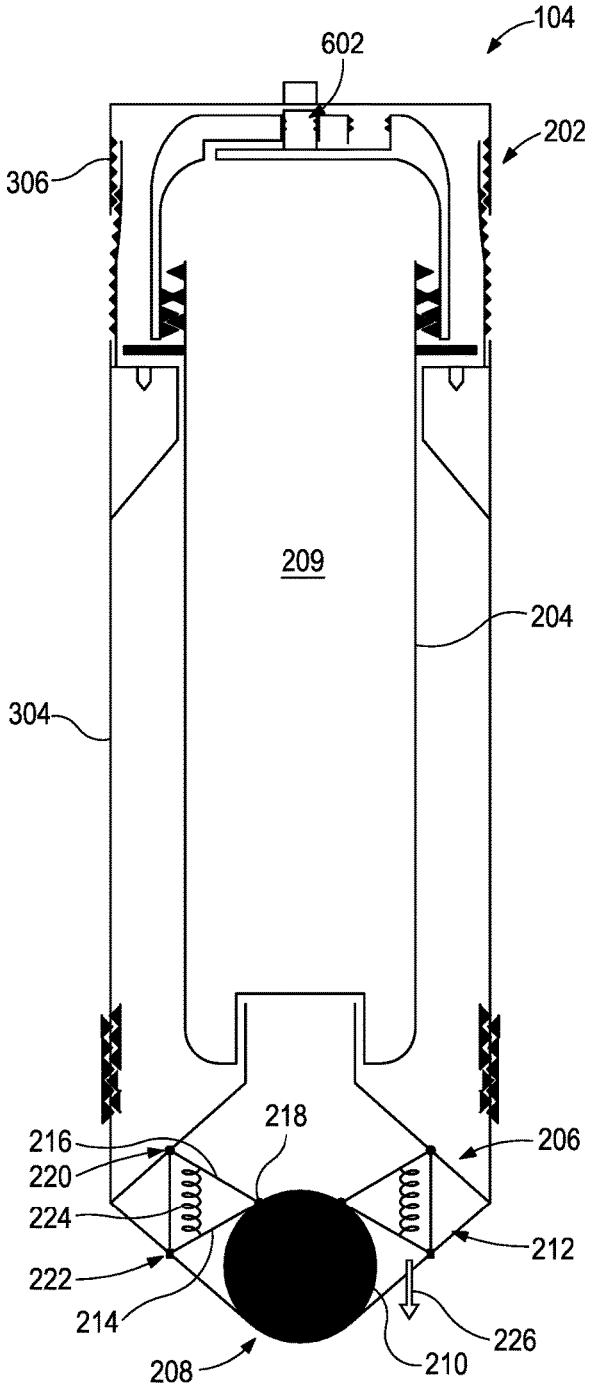
FIGS. 2A and 2B are enlarged schematic views of the sampling tool of FIG. 1 in closed and open configurations, respectively, the sampling tool including an outer tool body, a sampling vessel and a scaling mechanism.
Figure 2B:
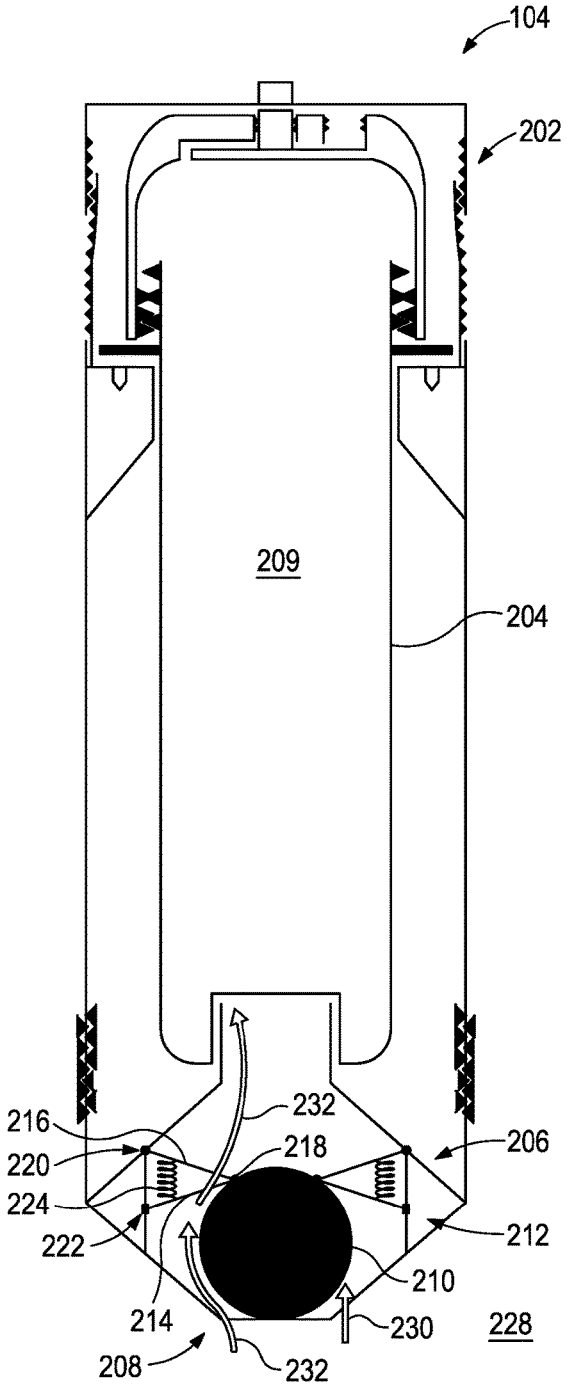

FIGS. 2A and 2B illustrate the sampling tool 104 in closed and open configurations, respectively. The sampling tool 104 generally includes an outer tool body 202, with a sampling vessel 204 and sealing mechanism 206 contained within the outer tool body 202. The outer tool body 202 may be constructed of a durable material (e.g., a metal, a composite material, a plastic, etc.) and serves to protect the sampling vessel 204 and scaling mechanism 206 contained therein. The sampling vessel 204 may be secured in the outer tool body 202 by fasteners 416 (FIG. 4), as described in greater detail below. In the closed configuration of FIG. 2A, the sealing mechanism 206 seals an opening 208 defined in the outer tool body 202 and prohibits fluid flow through the opening 208 into an interior 209 of the sampling vessel 204. In contrast, in the open configuration of FIG. 2B, the sealing mechanism 206 permits fluid flow through the opening 208 and into the interior 209 of the sampling vessel 204.

The sealing mechanism 206 generally includes a closure member 210 and a biasing mechanism 212 centralizing the closure member 210 and urging the closure member 210 into sealing engagement with the opening 208. The closure member 210 is illustrated as a spherical ball, but the closure member 210 may take any shape to correspond with a shape of the opening 208. The biasing mechanism 212 includes one or more leading arms 214 and one or more trailing arms 216, each of which may be constructed of a generally rigid elongate member. Each of the trailing arms 216 is pivotally coupled to a respective one of the leading arms 214 at a pivot joint 218 and pivotally coupled to the outer tool body 202 at a pivot joint 220. The pivot joints 218, 220 may include, for example, pinned hinges or a flexible material coupling the arms 214, 216. A sliding joint 222 is defined between the outer tool body 202 and the leading arm 214 at an end opposite the pivot joint 218. A biasing member 224, such as a helical compression spring. Belleville washer stack, wave washer and/or similar structure, is operatively coupled to the leading and trailing arms 214, 216 to naturally urge (bias) the arms 214, 216 away from one another. The biasing mechanism 212 biases the closure member 210 toward the opening 208 and permits movement of the closure member 210 away from the opening 208 along a single axial direction as described in greater detail below.

In the closed configuration of FIG. 2A, the biasing member 224 urges the leading arm 214 in the direction of arrow 226 to a forward position along the sliding joint 222. When the leading arm 214 is in the forward position, the leading arm 214 and/or the pivot joint 218 engages the closure member 210 to apply a force thereto in the direction of arrow 226, thereby seating the closure member 210 in the opening 208. To operate the scaling mechanism 206 to move the sampling tool 104 to the open configuration of FIG. 2B, the sampling tool 104 may be conveyed to a depth in the wellbore 102 (FIG. 1) that exhibits an increased ambient hydraulic pressure on an exterior 228 of the sampling tool 104. The ambient downhole pressure applies a force on the closure member 210 in the direction of arrow 230 sufficient to overcome the bias of the biasing mechanisms 212. As a result, the leading arms 214 are moved to a rearward (uphole) position along the sliding joint 222 compressing the biasing members 224. In the process, the closure member 210 is unseated or disengaged from the opening 208, thereby permitting flow of a formation fluid 232 through the opening 208 and into the sampling vessel 204. The sliding joints 222 ensure that the closure member 210 moves only axially in the rearward (uphole) and forward (downhole) directions of arrows 230, 226, respectively. The plurality of arms 214 circumferentially spaced around the closure member 210 prohibit movement of the closure member in any lateral direction that could create misalignment between the closure member 210 and the opening 208. Thus, the arrangement of the biasing mechanism 212 may ensure reliable opening and closing of the sampling tool 104 without undue intervention by an operator.

Figure 3:
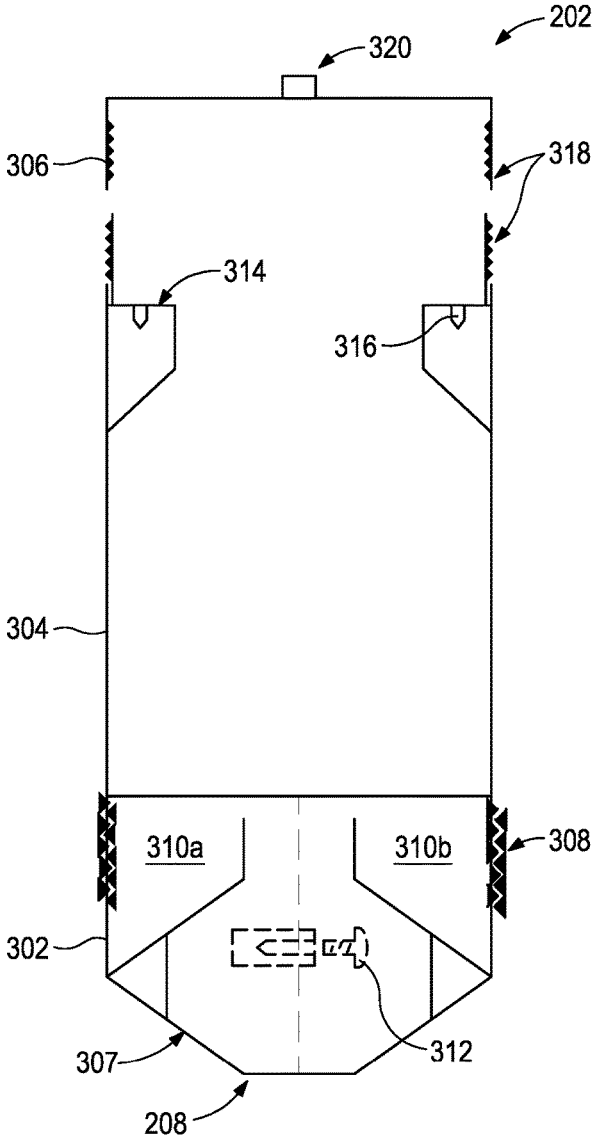
FIG. 3 is a schematic side view of the tool body of FIGS. 2A and 2B illustrating an intake, a main body and a lid of the tool body.

Referring to FIG. 3, the outer tool body 202 generally includes an intake 302, a main body 304 and a lid 306. The intake 302 generally houses the sealing mechanism 206 (FIGS. 2A and 2B) and defines the opening 208. A chamfer or taper 307 is defined around the opening 208 which facilitates downhole conveyance of the outer tool body 202 through the flow of fluids in the wellbore 102 (FIG. 1). A threaded coupling 308 or similar connector is provided between the intake 302 and the main body 304 to permit the intake 302 to be selectively removed from the main body 304. The intake 302 may be constructed as a hinged clamshell or as two semi-cylindrical walls 310*a*, 310*b* that may be opened and screwed together with fasteners 312. Removal and opening of the intake 302 may facilitate installation, inspection and maintenance of the sealing mechanism 206. For example, the walls 310*a*, 310*b* may be separated to permit the biasing mechanism 224 (FIG. 2A) to be replaced to adjust an opening pressure of the sampling tool 104.

The main body 304 may be constructed as a generally cylindrical tubular member with an interior shoulder 314 defined therein. The main body 304 is operable to house the sampling vessel 204 (FIG. 2A) therein. The interior shoulder 314 includes an array of threaded bores 316, which may facilitate attachment of the sampling vessel 204 (FIG. 2) within the outer tool body 202 as described in greater detail below. A threaded coupling 318 or similar connector is provided at a trailing (uphole) end of the main body 304 for selectively coupling the lid 306 to the main body 304. The lid 306 is selectively removable from the main body 304 to permit installation and access to the sampling vessel 204 (FIGS. 2A and 2B). A conveyance connector 320 is provided on the lid 306 to allow the outer tool body 202 to be secured to the slickline 106 (FIG. 1) or other conveyance.

Figure 4:
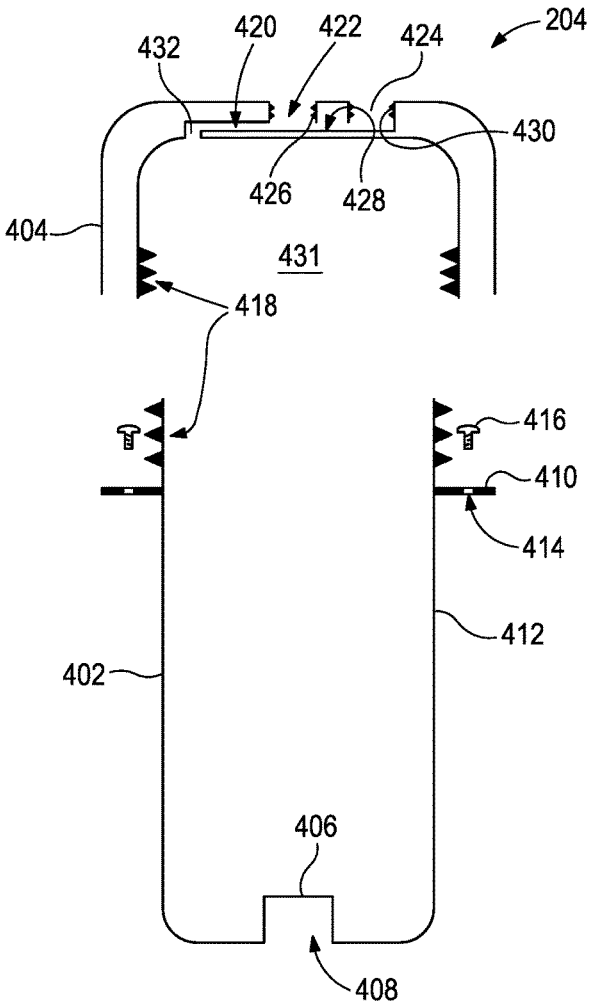
FIG. 4 is a schematic exploded side view of the sampling vessel of FIGS. 2A and 2B illustrating a container and a cap of the sampling vessel.

FIG. 4 illustrates an exploded view of the sampling vessel 204, which generally includes a container 402 and a cap 404. The container 402 includes a flapper 406 extending across an inlet 408. The flapper 406 may permit fluid flow in one direction. For example, the flapper 406 may permit fluid flow into the container 402 through the inlet 408 but prohibit fluid flow from the container 402 via the inlet 408. A flange 410 protrudes radially outwardly from a sidewall 412 of the container 402. The flange 410 may include an array of through bores 414 corresponding to the array of threaded bores 316 (FIG. 3) defined in the outer tool body 202. Thus, when the flange 410 rests on the interior shoulder 314 of the main body 304, a plurality of threaded fasteners 416 or screws may be extended through the co-axially aligned through bores 414 and threaded bores 316 (FIG. 3) to secure the container 402 in the outer tool body 202. A threaded coupling 418 or similar connector is provided between the container 402 and the cap 404 to permit selective removal of the cap 404 from the container 402. The cap 404 may be removed from the container 402 by an operator at the surface location "S" after collecting a fluid sample, for example, to pour liquids from the sampling vessel 204 and to clean and maintain the sampling vessel 204 for reuse in subsequent sample collection operations. In other embodiments, the cap 404 may be welded or otherwise permanently secured to the container 402, for example, in a single use sampling vessel 204 without departing from the scope of the disclosure.

The cap 404 defines a sampling flow path 420 extending therethrough to facilitate extraction of fluid samples collected in the sampling vessel 204. The sampling flow path 420 extends through a safety port 422 to a gas collection port 424. The safety port 422 includes threads 426 defined therein and extends to a floor 428. Similarly, the gas collection port 424 includes threads 430 therein and extends to the floor 428. The sampling flow path 420 extends generally from an interior 431 of the cap 404, through an inlet port 432 and along the floor 428 between the safety port 422 and the gas collection port 424.

Figure 5:
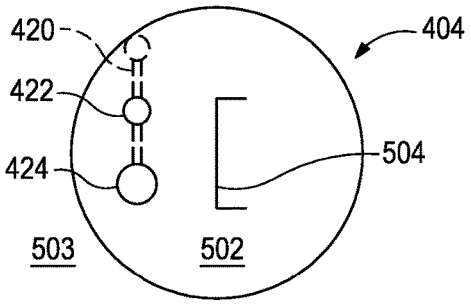
FIG. 5 is a schematic top view of the cap of FIG. 4 illustrating a plurality of plug ports defined in the cap.

As illustrated in FIG. 5, the safety port is 422 is spaced apart from the gas collection port 424 on a top surface 502 of the cap 404. When the safety port 422 and gas collection port 424 are open, as illustrated, fluids may pass from the sampling flow path 420 to an exterior 503 of the cap through both the safety port 422 and gas collection port 424. A handle 504 is also provided on the cap to facilitate manual pulling of the sampling vessel 204 (FIG. 2) from the outer tool body 202.

Figure 6A:
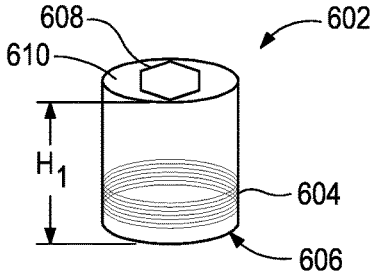
FIGS. 6A and 6B are schematic perspective views of a safety plug and a gas sampling plug, which are receivable in the plug ports of FIG. 5.

FIG. 6A illustrates a safety plug 602, which may be received within the safety port 204 to occlude the sampling flow path 420 (FIGS. 4 and 5) and thereby prohibit fluid flow therethrough. The safety plug 602 may be constructed as a generally solid cylinder that includes outer threads 604 corresponding to the threads 426 (FIG. 4) provided in the safety port 422 (FIGS. 4 and 5). Thus, the safety plug 602 may be threaded into the safety port 422 until a lower surface 606 of the safety plug 602 engages the floor 428 of the cap 404 and forms a seal therewith. Fluid flow from the sampling vessel 204 through the sampling flow path 420 may be thereby prohibited by the safety plug 602. A height H1 of the safety plug 602 may be sufficiently low that the safety plug 602 does not interfere with the lid 306 when the lid 306 is installed to the main body 304 (see, FIG. 2A). A drive feature such as the hexagonal socket 608 may be provided on the top surface 610 of the safety plug 602 to facilitate threading the safety plug 602 into and out of the safety port 422.

Figure 6B:
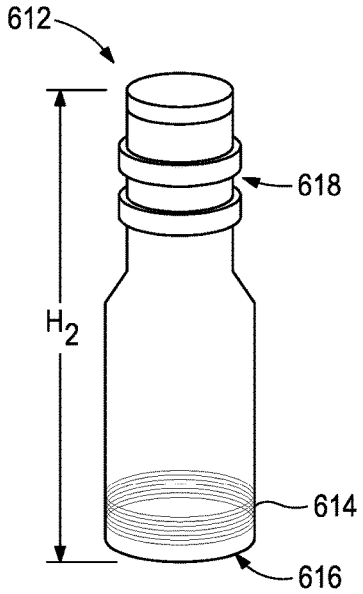

FIG. 6B illustrates an example gas sampling plug 612, which may be received within the gas collection port 424 (FIGS. 4 and 5) to access fluid samples collected in the sampling vessel 204. The gas sampling plug 612 may be constructed of a generally hollow tube and includes outer threads 614 that correspond to the threads 430 (FIG. 4) in the gas collection port 424. The gas sampling plug 612 may be threaded into the gas collection port 424 until a lower surface 616 of the gas sampling plug 612 is spaced from the floor 428 of the cap 404. Fluids in the sampling flow path 420 (FIGS. 4 and 5) may thus pass into the gas sampling plug 612, provided that the safety plug 602 (FIG. 6A) is also spaced from the floor 428 in the safety port 422. The safety plug 602 may be loosened in the port 422 to allow gas to migrate from the sampling vessel 204 to the gas sampling port 424 for analysis. The gas sampling plug 612 should be attached to the gas sampling port 424 before the safety plug is loosened so that the migrating gas may be collected for analysis. A nipple 618 or similar fitting is provided on the exterior of the gas sampling plug 612 opposite the threads 614. Tubing or other conduits (not shown) may connect to the nipple 618 to provide fluid communication between the sampling vessel 204 (FIG. 4) and analyzing instruments, such as gas chromatography equipment (not shown). A height H2 of the gas sampling plug 612 may be sufficiently large that the gas sampling plug 612 interferes with the lid 306 (FIG. 3) when the lid 306 is connected to the main body 304 of the tool body 202 (FIG. 2). The gas sampling plug 612 may thus be readily distinguishable from the safety plug 602 and may not be inadvertently installed while the sampling tool 104 is deployed on the wellbore 102.

Figure 7:
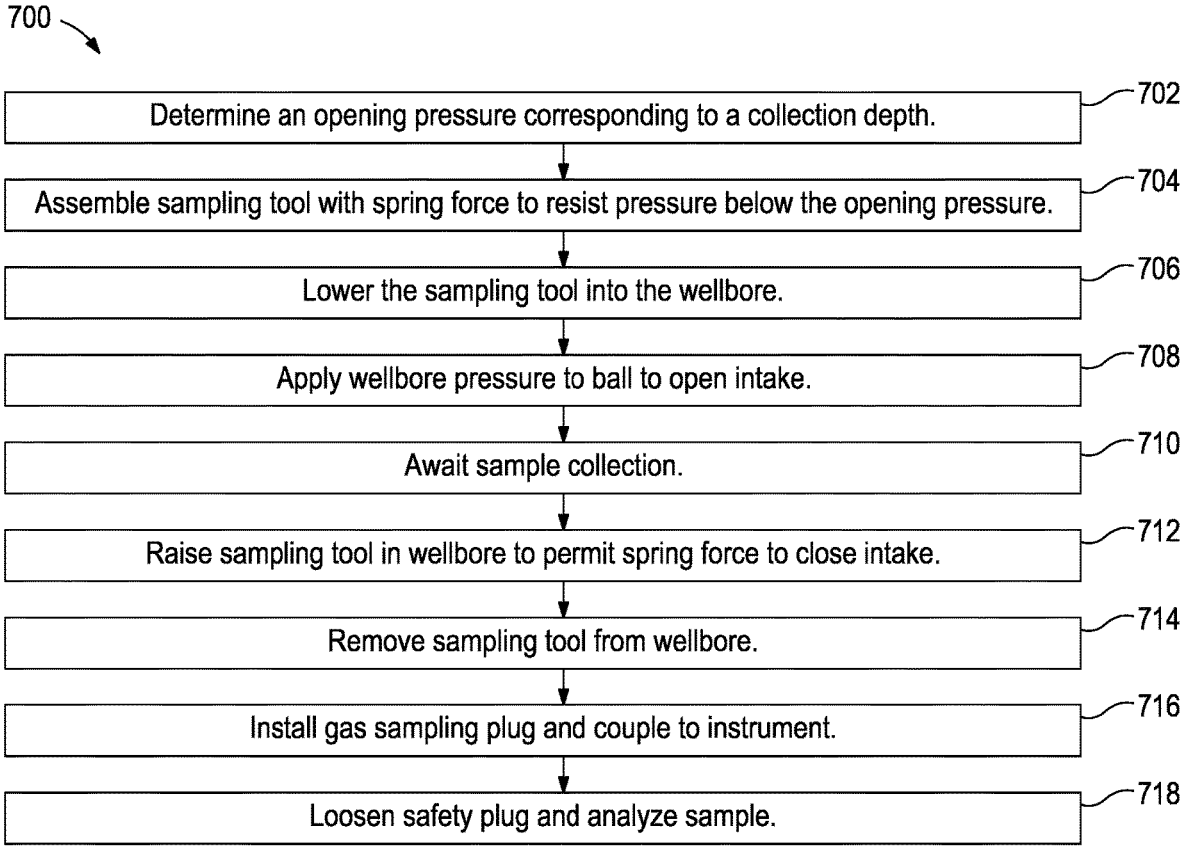
FIG. 7 is a flow chart illustrating a procedure for collecting and analyzing a fluid sample with the fluid sampling tool and well system of FIG. 1.

Referring now to FIG. 7, and with continued reference to FIGS. 1 through 6B, a procedure 700 is described for collecting and analyzing a fluid sample with the fluid sampling tool 104 and well system 100. Initially at step 702, a collection depth is identified at a location in wellbore 102 from which a fluid sample is desired. The hydrostatic pressure at the collection depth is determined, either empirically or experimentally, and an opening pressure at which the sampling tool 104 will open may be determined from the hydrostatic pressure.

Next at step 704, the sampling tool 104 is assembled with a biasing mechanism 212 having a spring force sufficient to resist pressure below the opening pressure. The number and spring constant of biasing members 224 may be selected to apply a sufficient biasing force to the closure member 210 to maintain the closure member 210 seated in the opening 208 against the force applied to the closure member 210 by the ambient fluid in the wellbore 102. The selected biasing members 224 may be installed by disengaging threaded coupling 308 to remove the intake 302 from the main body 304 and then by separating walls 310*a*, 310*b* of the intake to access the closure member 210 and biasing mechanism 212. Once the selected biasing members 224 are installed, the intake 302 may be reassembled and attached to the main body 304 by engaging threaded coupling 308. The sampling vessel 204 may be assembled by engaging the threaded coupling 418 to couple the cap 404 to the container 402, and the sampling vessel 204 may then be installed in the main body 304 by fastening the flange 410 to the interior shoulder 310 with fasteners 416. Next, the safety plug 602 may be threaded into the safety port 422 of the cap 404 until the lower surface 606 of the safety plug 602 engages the floor 428 of the cap 404 and forms a seal therewith. Once the safety plug 602 is installed, the sampling vessel 204 may form a fluid-tight enclosure. The lid 306 of the outer tool body 202 may be installed by engaging the threaded coupling 314 and then the conveyance connector 320 may be secured to the slickline 106. The sampling tool 104 may then be fully assembled and ready for deployment.

At step 706, the sampling tool 104 may be lowered or conveyed downhole into the wellbore 102 on the slickline 106. The sampling tool 104 may be lowered to the collection depth, for example 200 feet below the depth at which the ambient wellbore pressure was determined to open the sampling tool 104. At the collection depth, the wellbore pressure will be applied to the closure member 210 and the closure member 210 will disengage the opening 208 (step 708). The sampling tool 104 may be maintained at the collection depth for a predetermined time period (step 710) to allow wellbore fluid to move through the opening 208 and flapper 406 into the sampling vessel 204. Once the fluid sample has been collected, the sampling tool 104 may be raised or conveyed uphole in the wellbore 102 on the slickline 106. As the sampling tool 104 is raised, the ambient wellbore pressure decreases, and the biasing mechanism 212 consequently closes the sampling tool 104 by engaging the closure member 210 with the opening 208 (step 712). At step 714, the sampling tool may be removed from the wellbore 102 and the sampling vessel 202 may be delivered to a laboratory or other suitable site for analysis.

At step 716, the gas sampling plug 612 may be threaded into the gas collection port 424. The gas sampling plug 612 may also be coupled to an analyzing instrument (not shown) by tubing (not shown) or another other conduit coupled to the nipple 618. The safety plug 602 may then be loosened such that the lower surface 606 is spaced from the floor 428 of the cap 404 (step 718). The safety plug 602 should be maintained within the safety port 422 such that the fluid sample does not escape through the safety port 422. Spacing the safety port 602 from the floor 428 fluidly couples the sampling vessel 204 to the analyzing instrument. Specifically, the sampling vessel 204 is coupled to the instrument through the inlet port 432, sampling flow path 420, the gas collection port 424 and gas sampling plug 612 and the tubing coupled to nipple 618. The gas sample may thus be analyzed by the instrument.

Embodiments disclosed herein include:

A. A downhole fluid sampling tool can include a tool body defining an opening therein for drawing a formation fluid into the downhole sampling tool and a sampling vessel carried in the tool body. The sampling vessel can be operatively coupled to the opening to receive the formation fluid into an interior thereof. The downhole fluid sampling tool may further include a closure member selectively engageable with the opening to prohibit flow of the formation fluid through the opening and a biasing mechanism operably coupled to the closure member to bias the closure member into engagement with the opening. The biasing mechanism can be responsive to an increase in hydraulic pressure on the exterior of the sampling tool to a predetermined threshold pressure to permit movement of the closure member away from the opening and permit flow of the formation fluid through the opening and into the interior of the sampling vessel.

B. A downhole fluid sampling system may include a conveyance deployable into a wellbore and a tool body coupled to an end of the conveyance, the tool body defining an opening therein. The downhole fluid sampling system may further include at least one sampling vessel carried in the tool body, the sampling vessel operatively coupled to the opening to receive formation fluid into an interior of the sampling vessel. The downhole fluid sampling system may further include a closure member selectively engageable with the opening to prohibit flow of the formation fluid through the opening and a biasing mechanism operably coupled to the closure member to bias the closure member into engagement with the opening. The biasing mechanism may be responsive to an increase in hydraulic pressure on the exterior of the too body to a predetermined threshold pressure to permit movement of the closure member away from the opening and permit flow of the formation fluid through the opening and into the interior of the sampling vessel.

C. A method for collecting and analyzing a downhole fluid sample may include lowering a sampling tool into a wellbore to a predetermined depth, applying wellbore pressure at the predetermined depth to a closure member carried by the sampling tool to establish fluid communication between an exterior of the sampling tool and an interior of a sampling vessel carried by the sampling tool and receiving a sample of wellbore fluid from the predetermined depth into the sampling vessel. The method may further include raising the sampling tool in the wellbore above the predetermined depth and applying a biasing force to the closure member to obstruct fluid flow between the exterior of the sampling tool and the interior of the sampling vessel in response to raising the sampling tool. Element 2:

Each of embodiments A, B, and C may have one or more of the following additional elements in any combination: Element 1: wherein the biasing mechanism includes a plurality of substantially rigid forward arms circumferentially spaced around the closure member, each forward arm biased by a respective biasing member into engagement with the closure member. Element 2: wherein the biasing mechanism includes a plurality of substantially rigid forward arms circumferentially spaced around the closure member, each forward arm biased by a respective biasing member into engagement with the closure member. Element 3: wherein the biasing mechanism further includes a sliding joint defined between each of the forward arms and a wall of the tool body. Element 4: wherein the tool body includes an intake defining the opening and housing the closure member and biasing mechanism therein, the intake selectively removable from a main body of the tool body. Element 5: wherein the sampling vessel includes a gas collection port in fluid communication with the interior of the sampling vessel through a sampling flow path extending between the gas collection port and the interior of the sampling vessel. Element 6: wherein the sampling vessel further includes a safety port fluidly coupled to the sampling flow path between the gas collection port and the interior of the sampling vessel. Element 7: wherein the downhole sampling tool further includes a safety plug received in the safety port and occluding the sampling flow path.

Element 8: wherein the conveyance is a slickline cable devoid of power or fluid transmission conduits. Element 9: wherein the tool body includes an intake that houses the biasing mechanism therein, the intake selectively removable from a main body of the tool body, wherein the main body houses the sampling vessel. Element 10: wherein the intake includes separable outer walls fastened to one another and removable from one another to access the biasing mechanism. Element 11: wherein the sampling vessel includes a gas collection port and a safety port in fluid communication with the interior of the sampling vessel through a sampling flow path extending between the gas collection port and the interior, and wherein the safety port receives a plug therein to occlude the sampling flow path.

Element 12: wherein the method further includes selecting one or more biasing members to provide a biasing force to the closure member that is less than an opening pressure determined to present at the predetermined depth in the wellbore. Element 13: wherein the method further includes removing an intake from the sampling tool and separating walls of the intake to install the one or more biasing members therein to provide the biasing force to the closure member. Element 14: wherein the method further includes coupling a gas sampling plug to a gas collection port of the sampling vessel and extracting the sample of wellbore fluid through the gas sampling plug for analysis. Element 15: wherein the method further includes loosening a safety plug to establish fluid communication between the interior of the sampling vessel and the gas sampling plug. Element 16: wherein the method further includes coupling the tool body of the sampling tool to a conveyance, wherein lowering the sampling tool into the wellbore includes conveying the sampling tool into the wellbore on the conveyance. Element 17: wherein coupling the tool body to a conveyance includes coupling a slickline cable to a conveyance connector formed on the tool body.

By way of non-limiting example, exemplary combinations applicable to A, B. and C include: Element 1 with Element 2; Element 2 with Element 3; Element 5 with Element 6; Element 6 with Element 7; Element 9 with Element 10; Element 12 with Element 13; Element 14 with Element 15; and Element 16 with Element 17.

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains", "containing", "includes", "including." "comprises", and/or "comprising." and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation are used herein merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and is not limited to either unless expressly referenced as such.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The invention claimed is:

1. A downhole fluid sampling tool, comprising:

a tool body defining an opening therein for drawing a formation fluid into the downhole sampling tool;

a sampling vessel carried in the tool body and operatively coupled to the opening to receive the formation fluid into an interior thereof;

a closure member selectively engageable with the opening to prohibit flow of the formation fluid through the opening; and a biasing mechanism operably coupled to the closure member to bias the closure member into engagement with the opening and responsive to an increase in hydraulic pressure on the exterior of the sampling tool to a predetermined threshold pressure to permit movement of the closure member away from the opening and permit flow of the formation fluid through the opening and into the interior of the sampling vessel, wherein the biasing mechanism includes a plurality of substantially rigid forward arms circumferentially spaced around the closure member, each forward arm biased by a respective biasing member into engagement with the closure member.

2. The downhole sampling tool of claim 1, wherein the biasing mechanism further includes a plurality of substantially rigid trailing arms, each of the trailing arms pivotally coupled to a respective one of the forward arms and a respective one of the biasing members, the biasing members coupled between the respective trailing and leading arms to pivot the respective trailing and leading arms away from one another.

3. The downhole sampling tool of claim 2, wherein the biasing mechanism further includes a sliding joint defined between each of the forward arms and a wall of the tool body.

4. The downhole sampling tool of claim 2, wherein the closure member is a spherical ball engaged with respective pivot joints defined between the respective trailing and leading arms.

5. The downhole sampling tool of claim 1, wherein the tool body includes an intake defining the opening and housing the closure member and biasing mechanism therein, the intake selectively removable from a main body of the tool body.

6. The downhole sampling tool of claim 5, wherein the intake is constructed with a pair of semi-cylindrical walls that may be opened and screwed together with fasteners.

7. The downhole sampling tool of claim 1, wherein the sampling vessel includes a gas collection port in fluid communication with the interior of the sampling vessel through a sampling flow path extending between the gas collection port and the interior of the sampling vessel.

8. The downhole sampling tool of claim 7, wherein the sampling vessel further includes a safety port fluidly coupled to the sampling flow path between the gas collection port and the interior of the sampling vessel.

9. The downhole sampling tool of claim 8, further including a safety plug received in the safety port and occluding the sampling flow path.

10. The downhole sampling tool of claim 9, wherein the safety plug and the safety port include corresponding threads such that the safety plug may be threaded into and out of the safety port.

11. A downhole fluid sampling system, comprising:

a conveyance deployable into a wellbore;

a tool body coupled to an end of the conveyance, the tool body defining an opening therein;

at least one sampling vessel carried in the tool body, the sampling vessel operatively coupled to the opening to receive formation fluid into an interior of the sampling vessel;

a closure member selectively engageable with the opening to prohibit flow of the formation fluid through the opening; and a biasing mechanism operably coupled to the closure member to bias the closure member into engagement with the opening and responsive to an increase in hydraulic pressure on the exterior of the too body to a predetermined threshold pressure to permit movement of the closure member away from the opening and permit flow of the formation fluid through the opening and into the interior of the sampling vessel, wherein the tool body includes an intake that houses the biasing mechanism therein, the intake selectively removable from a main body of the tool body, wherein the main body houses the sampling vessel.

12. The downhole fluid sampling system of claim 11, wherein the conveyance is a slickline cable devoid of power or fluid transmission conduits.

13. The downhole fluid sampling system of claim 11, wherein the intake includes separable outer walls fastened to one another and removable from one another to access the biasing mechanism.

14. The downhole fluid sampling system of claim of claim 11, wherein the sampling vessel includes a gas collection port and a safety port in fluid communication with the interior of the sampling vessel through a sampling flow path extending between the gas collection port and the interior, and wherein the safety port receives a plug therein to occlude the sampling flow path.

15. A method for collecting and analyzing a downhole fluid sample, the method comprising:

lowering a sampling tool into a wellbore to a predetermined depth;

applying wellbore pressure at the predetermined depth to a closure member carried by the sampling tool to establish fluid communication between an exterior of the sampling tool and an interior of a sampling vessel carried by the sampling tool;

receiving a sample of wellbore fluid from the predetermined depth into the sampling vessel;

raising the sampling tool in the wellbore above the predetermined depth;

applying a biasing force to the closure member to obstruct fluid flow between the exterior of the sampling tool and the interior of the sampling vessel in response to raising the sampling tool; and coupling a gas sampling plug to a gas collection port of the sampling vessel and extracting the sample of wellbore fluid through the gas sampling plug for analysis.

16. The method of claim 15, further comprising selecting one or more biasing members to provide a biasing force to the closure member that is less than an opening pressure determined to present at the predetermined depth in the wellbore.

17. The method of claim 16, further comprising removing an intake from the sampling tool and separating walls of the intake to install the one or more biasing members therein to provide the biasing force to the closure member.

18. The method of claim 15, further comprising loosening a safety plug to establish fluid communication between the interior of the sampling vessel and the gas sampling plug.

19. The method of claim 15, further comprising coupling the tool body of the sampling tool to a conveyance, wherein lowering the sampling tool into the wellbore includes conveying the sampling tool into the wellbore on the conveyance.

20. The method of claim 19, wherein coupling the tool body to a conveyance includes coupling a slickline cable to a conveyance connector formed on the tool body.

* * * * *